US012258688B2

(12) United States Patent
Yin et al.

(10) Patent No.: US 12,258,688 B2
(45) Date of Patent: Mar. 25, 2025

(54) ELECTRONIC-INK-BASED COLORFUL PATTERNED COLOR-CHANGING FABRICS AND PREPARATION METHODS THEREOF

(71) Applicant: SOUTHEAST UNIVERSITY, Jiangsu (CN)

(72) Inventors: Chaoyi Yin, Nanjing (CN); Ruifang Liu, Nanjing (CN); Long Ba, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 18/726,407

(22) PCT Filed: Nov. 3, 2021

(86) PCT No.: PCT/CN2021/128284
§ 371 (c)(1),
(2) Date: Jul. 3, 2024

(87) PCT Pub. No.: WO2023/070699
PCT Pub. Date: May 4, 2023

(65) Prior Publication Data

US 2024/0417894 A1 Dec. 19, 2024

(30) Foreign Application Priority Data

Nov. 1, 2021 (CN) ..... 202111282361.6

(51) Int. Cl.
*D03D 1/00* (2006.01)
*D03D 11/00* (2006.01)
(Continued)

(52) U.S. Cl.
CPC ..... *D03D 1/0088* (2013.01); *D03D 1/0047* (2013.01); *D03D 1/0094* (2013.01);
(Continued)

(58) Field of Classification Search
CPC .. D03D 1/0088; D03D 1/0047; D03D 1/0094; D03D 11/00; D03D 15/533;
(Continued)

(56) References Cited

U.S. PATENT DOCUMENTS 7,785,496 B1 * 8/2010 Shim ..... C09D 11/32 252/511
9,846,105 B2 * 12/2017 Wu ..... G01M 5/0091
(Continued)

FOREIGN PATENT DOCUMENTS

CN 101211739 A 7/2008
CN 101828785 A 9/2010
(Continued)

OTHER PUBLICATIONS

First Office Action in Chinese Application No. 202111282361.6 mailed on Nov. 11, 2022, 18 pages.
(Continued)

*Primary Examiner* — Robert H Muromoto, Jr.
(74) *Attorney, Agent, or Firm* — Porus IP LLC

(57) ABSTRACT

Electronic-ink-based colorful patterned color-changing fabrics and preparation methods thereof are provided. The fabric includes a conductive fabric microstrip formed by weaving using conductive yarn and insulating yarn. The conductive yarn forms a conductive region, and the insulating yarn form an insulating region. An electronic ink microencapsule layer is arranged on the conductive region. A flexible transparent conductive layer is arranged on the electronic ink microencapsule layer. A transparent polymer layer is arranged on the flexible transparent conductive layer. A surface layer of the microstrip is a conductive layer, and a bottom layer of the microstrip is an insulating layer. An electrophoretic color-changing microencapsule, a conductive one-dimensional nanomaterial, and a transparent poly-
(Continued)

mer are uniformly coated on a surface of the microstrip, and a voltage output by a drive circuit is respectively applied to the conductive microstrip and the transparent conductive layer to achieve selective flip and color rendering of centimeter-scale micro-region on the surface of the microstrip. Upper and lower electrodes are connected with a control circuit to achieve centimeter-scale pixel control and large-size graphic display and make a conductive-fabric-substrate-based foldable, high-environmental tolerant low-cost large-area color display and adaptive visible light camouflage fabric.

9 Claims, 4 Drawing Sheets

(51) Int. Cl.
*D03D 15/533* (2021.01)
*D04B 21/08* (2006.01)
*D03D 15/67* (2021.01)

(52) U.S. Cl.
CPC ..... *D03D 11/00* (2013.01); *D03D 15/533* (2021.01); *D04B 21/08* (2013.01); *D10B 2403/02421* (2013.01); *D10B 2403/02431* (2013.01)

(58) Field of Classification Search
CPC ..... D04B 21/08; D10B 2403/02421; D10B 2403/02431
See application file for complete search history.

(56) References Cited

U.S. PATENT DOCUMENTS 10,273,600 B1* 4/2019 Bharadwaj ..... D03D 1/0088
2012/0224247 A1* 9/2012 Sotzing ..... H01M 4/02 429/341
2014/0011004 A1* 1/2014 Sotzing ..... B41M 5/0047 428/196
2016/0084733 A1* 3/2016 Wu ..... G01M 11/083 29/458
2017/0108403 A9* 4/2017 Wu ..... G01M 11/083
2017/0237365 A1* 8/2017 Kwon ..... H02N 1/04 310/310
2017/0253751 A1* 9/2017 Busbee ..... C09D 175/06
2018/0303383 A1* 10/2018 Connor ..... G06F 3/014
2021/0094270 A1 4/2021 Whiton et al.
2024/0008585 A1* 1/2024 Bock ..... A43B 3/0031

FOREIGN PATENT DOCUMENTS

CN 102208547 A 10/2011
CN 102527621 A 7/2012
CN 104216193 A 12/2014
CN 109031846 A 12/2018
CN 109642359 A 4/2019
CN 110093702 A 8/2019
CN 110181882 A 8/2019
CN 101714546 A 5/2020
CN 112226899 A 1/2021
CN 112813558 A 5/2021
CN 112864630 A 5/2021
WO 2015068654 A1 5/2015

OTHER PUBLICATIONS

Decision to Grant a Patent in Chinese Application No. 202111282361.6 mailed on Jan. 4, 2023, 4 pages.
International Search Report in PCT/CN2021/128284 mailed on Dec. 22, 2021, 7 pages.
Written Opinion in PCT/CN2021/128284 mailed on Dec. 22, 2021, 7 pages.

* cited by examiner

ELECTRONIC-INK-BASED COLORFUL PATTERNED COLOR-CHANGING FABRICS AND PREPARATION METHODS THEREOF

CROSS-REFERENCE TO RELATED APPLICATIONS

This application is a U.S. national stage under 35 U.S.C. § 371 of International Application No. PCT/CN2021/128284, filed on Nov. 3, 2021, designating the United States of America, which claims the priority of Chinese Patent Application No. 202111282361.6, filed on Nov. 1, 2021, the entire contents of which are hereby incorporated by reference.

TECHNICAL FIELD

The present disclosure relates to the field of adaptive visible light color rendering fabrics, and in particular, to electronic-ink-based adaptive visible light color rendering fabrics and preparation methods thereof.

BACKGROUND

Functional fibers formed by endowing fiber materials with new properties are used to prepare smart fabrics. Color-changing fabrics provide broad development for large-size dynamic pattern and text display fabrics, color-changing garments, camouflage cloth, camouflage fabrics for weapons and equipment, etc.

An electronic ink display element has certain market advantages due to its low power consumption and high visibility under strong light, but its high price and low contrast limit its application scenarios. The conductive fabrics being the substrate can give electronic ink new application opportunities, especially in the low-cost, large-area display, and dynamic camouflage scenarios. At present, an electronic ink display product in a form of electronic paper is limited in its application of flexible folding application scenarios due to its polymer bottom layer and its transparent Indium Tin Oxid (ITO) film top material. Preparation of small-sized pixels using photolithography also increases the cost, which is not conducive to the preparation of a display product with large-area and large-size pixels. There is currently no electronic ink display device with a fabric as a substrate.

In modern battlefield confrontation scenarios, the integrated use of reconnaissance equipment makes camouflage effect of traditional digital camouflage severely affected. Camouflage masking equipment with color of dynamic environmental adaptability and variable patterns makes camouflaged objects completely hidden in the natural environment, which may greatly improve the confrontation advantage of their own personnel and equipment on the battlefield. The electronic ink becomes an ideal material for adaptive camouflage in the visible light band due to the reflective color rendering principle.

The Chinese patent application with application No. 2010101365461 discloses a color-changing camouflage fabric based on electronic ink display technology and the preparation method thereof. Although the interchanging of two or more camouflage patterns on the surface of the fabric is achieved, the fabric is not flexible due to the use of the ITO film on an upper electrode thereon. In addition, the obtained fabric is only adaptive in a set camouflage pattern and cannot achieve the integration of any environment. Therefore, it is desirable to provide a method for preparing an electronic-ink-based colorful patterned color-changing fabric, which can realize that the obtained camouflage fabric has full flexibility and a characteristic of arbitrary environmental integration using a centimeter-sized pixel-controlled display manner.

SUMMARY

Purpose of Invention: some embodiments of the present disclosure provide an electronic-ink-based colorful patterned color-changing fabric with high contrast, high bending resistance, and an appropriate electrophoretic color rendering voltage. Some embodiments of the present disclosure further provide a method for preparing an electronic-ink-based colorful patterned color-changing fabric.

Technical scheme: an electronic-ink-based colorful patterned color-changing fabric provided by the present disclosure may include a conductive fabric microstrip formed by weaving using conductive yarn and insulating yarn, the conductive yarn forming a conductive region, the insulating yarn forming an insulating region. An electronic ink microencapsule layer may be arranged on the conductive region for image display. The electronic ink microencapsule layer may include an electronic ink microencapsule slurry and an adhesive. A flexible transparent conductive layer may be arranged on the electronic ink microencapsule layer for providing an electrophoretic color rendering voltage. The flexible transparent conductive layer may include a single-walled carbon nanotube and a silver nanowire slurry. A transparent polymer layer may be arranged on the conductive fabric microstrip for encapsulation.

Further, the conductive fabric microstrip may be a double-layer structure formed by the conductive yarn and the insulating yarn through weaving, bonding, or knitting. The conductive region may be located at a central surface of the conductive fabric microstrip, and the insulating region may be located at an edge and a bottom of the conductive fabric microstrip.

Further, the conductive yarn may include at least one of silver-plated conductive yarn or conductive nano-material-coated conductive yarn. A yarn size of the at least one of silver-plated conductive yarn or conductive nano-material-coated conductive yarn may be smaller than or equal to 100 D, and a monofilament size of the at least one of silver-plated conductive yarn or conductive nano-material-coated conductive yarn may be smaller than or equal to 30 D. The insulating yarn may include at least one of nylon, polyester, or polypropylene, or blended yarn. A yarn size of the at least one of nylon, polyester, or polypropylene, or blended yarn may be smaller than or equal to 100 D, and a monofilament size of the at least one of nylon, polyester, or polypropylene, or blended yarn may be smaller than or equal to 15 D.

Further, the silver nanowire slurry may be an ethanol solution of the silver nanowires or an aqueous solution of the silver nanowires, and the silver nanowires may have an average diameter of 15 nm~20 nm and an aspect ratio of 1000~2000. A carbon nanotube slurry may be an aqueous solution of single-walled carbon nanotubes grown by gas-phase catalytic growth. A transparency of the dried silver nanowire slurry may be larger than or equal to 90%, and a square resistance of the dried silver nanowire slurry may be smaller than or equal to 150Ω.

Further, the electronic ink microencapsule slurry may include electrophoretic particles that achieve two-color interchanging under different voltages or multicolor electrophoretic particles with different electrophoretic mobility.

The two-color interchanging may include interchanging of at least one of black and white, blue and white, red and white, or green and white.

Further, the conductive fabric microstrip may be further provided with the drive circuit for applying the voltage and the pixel selection chip for controlling the drive circuit to form a pattern on a surface of the color-changing fabric. The pixel selection chip may be signally connected to the drive circuit, and a signal output end of the drive circuit may be connected to the conductive region and the flexible transparent conductive layer respectively.

The present disclosure further discloses a method for preparing the electronic-ink-based colorful patterned color-changing fabric. The method may include follow steps:

step 1, weaving the conductive yarn and the insulating yarn into the conductive fabric microstrip using a double-layer warp knitting process, the conductive yarn and the insulating yarn constructing the conductive region and the insulating region, respectively, on the conductive fabric microstrip;

step 2, uniformly coating the electronic ink microencapsule slurry mixed with the adhesive to the conductive region and forming the electronic ink microencapsule layer after curing;

step 3, coating the silver nanowire slurry on a surface of the electronic ink microencapsule layer and drying, coating a single-walled carbon nanotube aqueous solution on the dried surface of the electronic ink microencapsule layer to form the flexible transparent conductive layer after being blow-dried, and sewing the conductive yarn in a direction perpendicular to a length of the conductive fabric microstrip, so that the conductive yarn conduct with the flexible transparent conductive layer and are fixed to the conductive fabric microstrip;

step 4, cutting and disconnecting the conductive region with a low-energy Yttrium Aluminum Garnet (YAG) laser to form independent display pixels;

step 5, uniformly coating a transparent polymer slurry on a surface of the conductive fabric microstrip to form the transparent polymer layer;

step 6, applying a voltage output from a drive circuit to the conductive region and the flexible transparent conductive layer respectively to flip color rendering of a discrete single pixel for by electrophoresis; and step 7, weaving or splicing the conductive fabric microstrip into a dynamic color rendering module with a fixed pixel density or a fixed size, and splicing a plurality of modules together to form a display device expandable to any size; and modulating, by a pixel selection chip, a voltage of the dynamic color rendering module through a gate voltage control drive circuit to display a simulated environment fusion pattern on the dynamic color rendering module.

In the step 1, the conductive yarn and the insulating yarn may be woven into a double-layer microstrip structure using a double-layer weaving process. An edge and a bottom of the microstrip may be made of the insulating yarn, and a central surface of the microstrip may be made of the conductive yarn. The conductive yarn and the insulating yarn may be woven into a double-layer structure using the warp-knitting process. The conductive microstrip woven by the conductive yarn may be bonded in the middle of the insulating microstrip woven by the insulating yarn through bonding using a water-based adhesive, so that a bottom layer of the microstrip may be made of the insulating yarn, and an upper layer of the microstrip may be made of the conductive yarn. A thickness of the double-layer microstrip may be 50 μm~150 μm, and a square resistance of the conductive microstrip may be 10 Ω~150 Ω.

In the step 2, a volume ratio of the electronic ink microencapsule slurry to the adhesive may be (1.5~2.5):1. The adhesive may be a waterborne polyurethane, a waterborne polyacrylic acid, or a mixture of the waterborne polyurethane and the waterborne polyacrylic acid. A concentration of the adhesive may be 10 wt %~30 wt %, and a concentration of the electronic ink microencapsule slurry may be 1.1 g/cm$^3$~1.3 g/cm$^3$.

In the step 3, the carbon nanotube slurry may be an aqueous solution of single-walled carbon nanotubes grown by gas-phase catalytic growth. The silver nanowire slurry may be an ethanol solution of the silver nanowires or an aqueous solution of the silver nanowires. A transparency of the dried silver nanowire slurry may be larger than or equal to 90%, and a square resistance of the dried silver nanowire slurry may be smaller than or equal to 150Ω. The conductive yarn may be a bundle of wires composed of silver-plated fibers. The bundle of wires may be 40D20F, and a centimeter resistance of the bundle of wires may be 5 Ω~100Ω. A concentration of silver nanowires in the silver nanowire slurry may be $1\times10^{-2}$ wt %~$1\times10^{-3}$ wt %, and a concentration of single-walled carbon nanotubes in the single-walled carbon nanotube aqueous solution may be $1\times10^{-3}$ wt %~$1\times10^{-4}$ wt %.

In the step 4, the conductive region of the microstrip may be separated by a laser to form independent controllable color rendering pixels. An overall image or character may be formed by controlling a single pixel grayscale. The laser may be a YAG laser (wavelength of 1.06 μm) with an output power of smaller than 10 watts, a spot size of smaller than 0.1 μm, and a scanning speed of 0.1 m/s~1 m/s.

In the step 5, a transparent polymer may be a non-conductive polymer, which adopts a polymer material with ambient temperature curing or high-temperature fast-curing. The overall abrasion resistance of the microstrip which may be adjusted by adjusting a coating thickness of the waterborne polyurethane. The transparent polymer in the transparent polymer layer may include the waterborne polyurethane, the waterborne polyacrylic acid, or a mixture of the waterborne polyurethane and the waterborne polyacrylic acid. A concentration of the transparent polymer may be 10 wt %~30 wt %, and a thickness of the transparent polymer after curing may be 1 μm~3 μm.

In the step 6, the drive circuit may include a thin-film field-effect transistor, a scanning driver chip, and a drive power supply. A gate and a drain of the thin-film field-effect transistor may be connected to a signal output terminal of a scanning driver chip through a signal wire. A voltage output end of the thin-film field-effect transistor may be connected to the conductive region and the transparent conductive layer, respectively. The scanning driver chip may be electrically connected to the drive power supply through a power wire. The signal wire and the power wire may be all made of the conductive yarn. The drive circuit may regulate the output voltage by controlling the external drive power supply. Each pixel may be driven by a thin-film transistor. The thin-film transistor may be attached to the back of a single pixel color block. An input wire and an output wire of the transistor may be all made of the conductive yarn. A gate voltage and a drain voltage of the transistor may be controlled by the scanning driver chip integrated into the single conductive fabric microstrip. The scanning driver chip may apply an amplitude output by a power supply circuit, a pulse voltage of time modulation to a single pixel to obtain a 16-level grayscale black-and-white or color display, which may achieve dynamic control of the grayscale and cloth image of a single pixel, a flip time of the single pixel of less than 1 s.

In the step 7, the dynamic color rendering module with the fixed pixel density or fixed size may be a camouflage cloth detachable unit woven or spliced by conductive fabric microstrips of different colors, and the dynamic color rendering module may include a power supply and an output voltage modulation module, a pattern storage, a decoding chip, and a communication chip. An environment simulation image generated by an image control computer may be assigned to a single dynamic color rendering module through pattern segmentation, and a grayscale control voltage generated by the voltage modulation module may be applied to each pixel of the dynamic color rendering module through a microstrip pixel scanning chip and a pixel drive circuit to realize the dynamic adaptive environment simulation patterned color rendering of the entire camouflage cloth.

The molding principle of the present disclosure is as follows. In some embodiments of the present disclosure, the prefabricated double-layer conductive fabric microstrip may be used. The insulating yarn may be woven into a bottom layer, and the conductive yarn may be woven into a bottom layer of an electronically controlled electronic ink electrophoresis flip structure. The thickness of the double-layer microstrip may be 50 μm~150 μm, and the square resistance of the conductive fabric microstrip may be 10 Ω~150Ω. The electronic ink microencapsule slurry may be mixed with the adhesive and coated on the surface of the conductive fabric microstrip, after curing, the silver nanowires and the single-walled carbon nanotubes may be coated on the surface of the color-rendering layer of the electronic ink microencapsule to form the flexible transparent conductive layer. The color and grayscale of the independent pixels may be controlled by the drive circuit, and the pattern output by the computer may be displayed on a fabric surface of a large area. The flexible transparent conductive layer may include the single-walled carbon nanotube and a silver nanowire coating layer slurry. The flexible transparent conductive layer has high transparency, high bending resistance, and effective electrophoretic electric field uniformity, temperature, chemical environment, and aging stability. Since the silver nanowire conductive network is in contact with the electronic ink microencapsule layer, compared to Indium Tin Oxide (ITO) transparent conductive film, the silver nanowire conductive network has an outstanding bending resistance and a smaller bending radius. The single-walled carbon nanotube is coated on the silver nanowire network, which may not only greatly improve the bending resistance, but also make an electrode have a larger charge under the same bias voltage due to the super capacitive nature of the single-walled carbon nanotube, therefore having a greater field strength. Under the same electronic ink reflectivity, the silver nanowire may reduce the bias voltage, the single-walled carbon nanotube may also make the flexible electrode have a higher bending resistance and have a synergistic enhancement effect of flexibility, transparency, and electrical conductivity.

Compared with the prior art, the present disclosure has following benefits. (1) The electronic-ink-based colorful patterned color-changing fabric prepared by the above preparation method may adjust the color and pattern of the camouflage cloth and camouflage equipment in real-time according to the environmental image, have the advantages of simple structural design and high stability performance of color-changing, and may be expanded into the standard-size dynamic color-developing module and spliced into a flexible camouflage cloth and structure of any size by reasonably designing the size of the microstrip and coating the electronic ink microencapsule with electrophoretic particles of different colors as the basic units; (2) The present disclosure provides a preparation method suitable for mass production of large-area flexible reflective display and adaptive camouflage textiles. With the color electronic ink microstrip as the basic unit, the independent pixel may be controlled easily. The microstrips of different colors may be mixed and woven, which may form a large area patterned display. The displayed pattern may be fused with the background, which may achieve a large-area adaptive stealth effect. The conductive layer on the surface of the microstrip may be made of one-dimensional nanomaterials, which has good bending resistance, and the encapsulated textiles with good water resistance, and durability have a wealth of secondary development potential as a basic material and have a wide range of applications prospects; (3) The above fabric may not only be used for large-area, low-cost colorful patterned display, but also may be used for military adaptive visible-light camouflage equipment, and may make the sheltered object actively hide into the environment by generating the environment simulation pattern on the surface of the flexible fabric to achieve dynamic adaptive stealth, greatly improving the advantage of the side in the battlefield confrontation. At the same time, the flexible color display fabric also has a wide range of application value in the civil field. The flexible color display fabric may be made into a large-area dynamic display mural, advertisements, and other reflective display products, with performance advantages of low cost, foldable, and easy to use.

DETAILED DESCRIPTION

Figure 1:
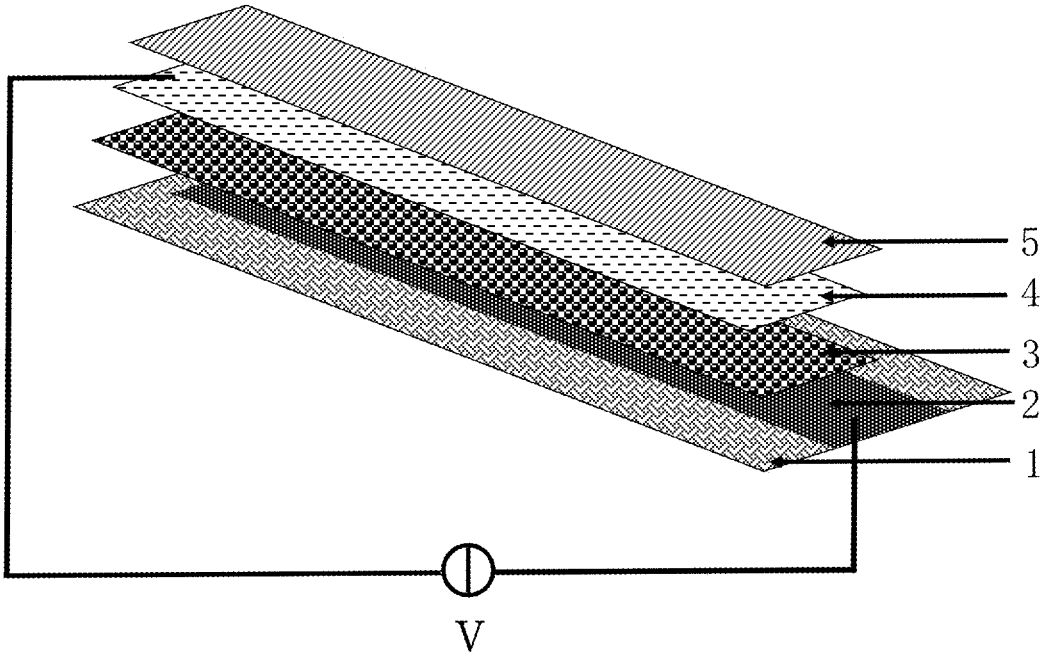
FIG. 1 is a schematic diagram illustrating a structure of the colorful patterned color-changing fabric according to the present disclosure.

The technical solution of the present disclosure is described in further detail below in connection with the accompanying drawings and embodiments.

Embodiment 1

(1) Conductive yarn and insulating yarn were woven into a double-layer conductive fabric microstrip with a width of 12 mm using a double-layer warp knitting process. An edge of the double-layer conductive fabric microstrip was made of the insulating yarn. A center surface of the double-layer conductive fabric microstrip was made of the conductive yarn. The conductive yarn was 70D24F silver-plated conductive yarn. The insulating yarn was 70D24F nylon yarn. The conductive yarn was woven into a center region of the microstrip. A width of the conductive region was about 10 mm, and a width of the edge layer on both sides of the double-layer conductive fabric microstrip was about 1 mm. A square resistance of the conductive fabric microstrip was ~1Ω.

(2) The woven microstrip was coiled and introduced into a glue scrapper. A plurality of microstrips were arranged in parallel. Each of the microstrips was provided with a glue-dropping head. The electronic ink microencapsule slurry and a waterborne polyurethane mixed slurry were drop-applied to a center of the microstrip conductive region. The electronic ink microencapsule slurry had a density of 1.20 g/cm$^3$. The polyurethane slurry was 9006A waterborne polyurethane produced by Shanghai Bihe Industrial and Trade Company. The electronic ink microencapsule slurry was mixed with polyurethane at a volume ratio of 2:1 through ultrasonic oscillation for 10 min. After the coating was completed, the microstrips were continuously dried and cured in a drying oven at 90° C. for 15 min. An overall thickness of a microstrip substrate and the cured electronic ink was about 200 μm, and a thickness of the electronic ink microencapsule layer was 90 μm.

(3) The cured continuous microstrips were introduced into a glue-coating machine. The plurality of microstrips were arranged in parallel. Each of the microstrips was provided with a glue-coating head. A diluted silver nanowire ethanol solution was uniformly brushed on a surface of the microstrip electronic ink cured adhesive layer through a narrow slit of the glue-coating head. The microstrips were continuously dried in the drying oven at 90° C. for 2 min. A square resistance of the dried and transparent silver nanowire layer was 150Ω. A diluted single-walled carbon nanotube aqueous solution was spray-coated on the surface of the microstrips at a spray rate of 0.1 mL/s. The carbon nanotube was repeatedly spray-coated after hot air blow-drying. A hot air temperature was lower than 90° C. A total number of spray-coating was 2 times. After the hot air blow-drying, the conductive yarn was sewed with insulating filament in a direction perpendicular to a length of the microstrip, so that the conductive yarn conducted with the conductive layer of a conductive layer on the surface and was fixed with a bottom layer of the microstrips. An average diameter of the silver nanowires was 20 nm, and an aspect ratio of the silver nanowires was 1000. A concentration of silver nanowires in the silver nanowire slurry was $1\times10^{-2}$ wt %, and a concentration of single-walled carbon nanotubes in the single-walled carbon nanotube aqueous solution was $1\times10^{-3}$ wt %.

(4) The microstrips were introduced into a scraper, and a transparent polymer waterborne polyurethane 9006A slurry was uniformly coated on the surface of the microstrips. After coating, the microstrips were continuously dried and cured in a drying oven at 90° C. for 15 min, and an insulating encapsulation layer was formed after curing. After being wound up, the microstrips was prepared into a semi-finished product of colorful electronic ink microstrips. A concentration of the transparent polymer was 20 wt %, and a thickness after curing was 2 μm.

Figure 2:
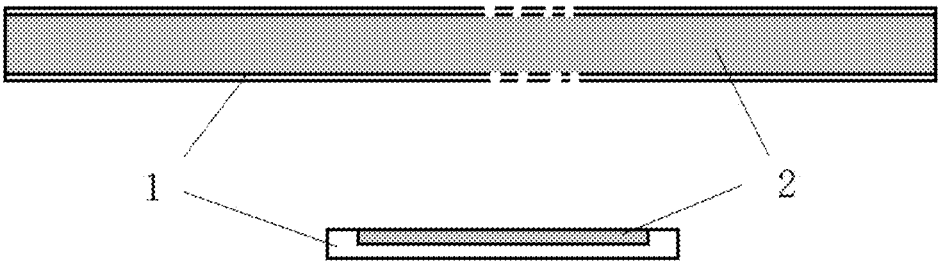
FIG. 2 is a schematic diagram illustrating a bilayer structure of a conductive fabric microstrip according to the present disclosure.

The structure of the obtained colorful patterned color-changing fabric, referring to FIG. 1 and FIG. 2, may include a conductive fabric microstrip formed by weaving conductive yarn 2 and insulating yarn 1. The conductive yarn 2 may form a conductive region. The insulating yarn 1 may form an insulating region. An electronic ink microencapsule layer 3 may be arranged on the conductive region for image display. A flexible transparent conductive layer 4 may be arranged on the electronic ink microencapsule layer 3 for providing an electrophoretic color rendering voltage. A transparent polymer layer 5 may be arranged on the conductive fabric microstrip for encapsulation.

Before encapsulation, the conductive region was cut and disconnected by a low-energy Yttrium Aluminum Garnet (YAG) laser with a laser wavelength of 1.06 μm, a spot size of smaller than 0.1 μm, and a scanning speed of 0.1 m/s~1 m/s to form independent square display pixels. A designed color-rendering fabric or camouflage cloth of any size was woven using the colorful microstrip semi-finished product and a vertical weaving manner in an order of red, green, and blue. A pixel drive chip was sewn on a back insulating layer. A pin of the pixel drive chip was connected to the conductive yarn connected to an upper electrode on a monochrome color block on a surface of a woven product through sewing to control color and grayscale of a colorful pixel unit. The pixel control circuit was connected to an output port of an image control circuit with the conductive yarn to achieve dynamic display of an image on a textile. An electronic ink microencapsule may optionally include two particles of opposite charges and different colors, such as blue-white interconversion, black-white interconversion, red-white interconversion, green-white interconversion, etc. to form a monochromatic pixel space mixing. The electronic ink microencapsule may also include a single microencapsule containing multi-color electrophoretic particles, the color mixing in the capsule may be controlled by adjusting a voltage, and the microstrips arranged in parallel may be sewn into a dynamic pattern display textile with any size, to achieve a richer display effect.

Embodiment 2

(1) Conductive yarn and insulating yarn was woven into a double-layer conductive fabric microstrip with a width of 12 mm using a double-layer warp knitting process. An edge was made of the insulating yarn. A center surface was made of the conductive yarn. The conductive yarn was 70D24F silver-plated conductive yarn. The insulating yarn was polyester yarn 75D72F. The conductive yarn was woven into a center region of the microstrip. A width of the conductive region was about 10 mm, and a width of the edge layer on both sides was about 1 mm. The conductive region was silver-plated with a thickness of about 2 μm after the microstrip was woven, and a square resistance of the conductive microstrip was ~1Ω.

(2) The woven continuous microstrip was coiled and introduced into a glue scrapper. A plurality of microstrips were arranged in parallel. Each of the microstrips was provided with a glue-dropping head. The electronic ink microencapsule slurry and a waterborne polyurethane mixed slurry were drop-applied to the center of the microstrip conductive region. The electronic ink microencapsule slurry had a density of 1.10 g/cm$^3$. The polyurethane slurry was 9006A waterborne polyurethane produced by Shanghai Bihe Industrial Trade Company. The electronic ink microencapsule slurry was mixed with polyurethane at a volume ratio of 1.5:1 through ultrasonic oscillation for 10 min. After the coating was completed, the microstrips were continuously dried and cured in a drying oven at 90° C. for 15 min. An overall thickness of a microstrip substrate and the cured electronic ink was about 200 μm, and a thickness of the electronic ink microencapsule layer was 90 μm.

(3) The cured continuous microstrips were introduced into a glue-coating machine. The plurality of microstrips were arranged in parallel. Each of the microstrips was provided with a glue-coating head. A diluted silver nanowire aqueous solution was uniformly brushed on a surface of the microstrip electronic ink cured adhesive layer through a narrow slit of the glue-coating head. The microstrips were continuously dried in the drying oven at 90° C. for 20 min. A square resistance of the dried and transparent silver nanowire layer was 150Ω. A diluted single-walled carbon nanotube aqueous solution was spray-coated on the surface of the microstrips at a spray rate of 0.1 mL/s. The carbon nanotube was repeatedly spray-coated after hot air blow-drying. A hot air temperature was lower than 90° C. A total number of spray-coating was 2 times. After the hot air blow-drying, the conductive yarn was be sewed with insulating filament in a direction perpendicular to a length of the microstrips, so that the conductive yarn conducted with a conductive layer on the surface and was fixed with a bottom layer of the microstrips. An average diameter of the silver nanowires was 15 nm, and an aspect ratio of the silver nanowires was 2000. A concentration of silver nanowires in the silver nanowire slurry was $1\times10^{-3}$ wt %, and a concentration of single-walled carbon nanotubes in the single-walled carbon nanotube aqueous solution was $1\times10^{-4}$ wt %.

(4) The microstrips were introduced into a scraper, and a transparent polymer waterborne polyacrylic acid slurry was uniformly coated on the surface of the microstrips. After coating, the microstrips were continuously dried and cured in the drying oven at 90° C. for 15 min, and an insulating encapsulation layer was formed after curing. After being wound up, the microstrips were prepared into a semi-finished product of colorful electronic ink microstrip. A concentration of the transparent polymer was 10 wt %, and a thickness of the transparent polymer after curing was 1 μm.

Before encapsulation, the conductive region was cut and disconnected by a low-energy YAG laser with a laser wavelength of 1.06 μm, a spot size of smaller than 0.1 μm, and a scanning speed of 0.1 m/s~1 m/s to form independent square display pixels. A designed color-rendering fabric or camouflage cloth of any size was woven using the colorful microstrip semi-finished product and a vertical weaving manner in an order of red, green, and blue. A pixel drive chip was sewn on a back insulating layer. A pin of the pixel drive chip was connected to the conductive yarn connected to an upper electrode on a monochrome color block on a surface of a woven product through sewing to control color and grayscale of a colorful pixel unit. The pixel control circuit was connected to an output port of an image control circuit with the conductive yarn to achieve dynamic display of an image on a textile.

Embodiment 3

(1) Conductive yarn and insulating yarn was woven into a double-layer conductive fabric microstrip with a width of 12 mm using a double-layer warp knitting process. An edge was made of the insulating yarn. A center surface was made of the conductive yarn. The conductive yarn coating was conductive nanomaterial-coated conductive yarn. The nanomaterial in the coating of the conductive yarn was carbon nanotubes and silver nanowires, and the specification was 75D3F. The insulating yarn was polypropylene yarn, and the specification was 75D36F. The conductive yarn was woven into a center region of the microstrip using a high-density knitting process. A width of the conductive region was about 10 mm, and a width of the edge layer on both sides was about 1 mm. A square resistance of the conductive microstrip was ~1Ω.

(2) The woven continuous microstrip was coiled and introduced into a glue scrapper. A plurality of microstrips were arranged in parallel. Each of the microstrips was provided with a glue-dropping head. A mixed slurry of the electronic ink microencapsule slurry and the waterborne polyacrylic acid was drop-applied to a center of the microstrip conductive region. The electronic ink microencapsule slurry had a density of 1.35 g/cm$^3$. The electronic ink microencapsule slurry was mixed with the waterborne polyacrylic acid at a volume ratio of 2.5:1 through ultrasonic oscillation for 10 min. After the coating was completed, the microstrips were continuously dried and cured in a drying oven at 90° C. for 15 min. An overall thickness of a microstrip substrate and the cured electronic ink was about 200 μm, and a thickness of the electronic ink microencapsule layer was 90 μm.

(3) The cured continuous microstrips were introduced into a glue-coating machine. The plurality of microstrips were arranged in parallel. Each of the microstrips was provided with a glue-coating head. A diluted silver nanowire aqueous solution was uniformly brushed on a surface of the microstrip electronic ink cured adhesive layer through a narrow slit of the glue-coating head. The microstrips were continuously dried in the drying oven at 90° C. for 20 min. A square resistance of the dried and the transparent silver nanowire layer was 150Ω. A diluted single-walled carbon nanotube was spray-coated on the surface of the microstrips at a spray rate of 0.1 mL/s. The carbon nanotube aqueous solution was repeatedly spray-coated after hot air blow-drying. A hot air temperature was lower than 90° C. A total number of spray-coating was 2 times. After the hot air blow-drying, the conductive yarn was sewed with insulating filament in a direction perpendicular to a length of the microstrips, so that the conductive yarn conducted with the conductive layer on the surface and was fixed with a bottom layer of the microstrips. An average diameter of the silver nanowires was 20 nm, and an aspect ratio of the silver nanowires was 1000. A concentration of silver nanowires in the silver nanowire slurry was $1\times10^{-2}$ wt %, and a concentration of single-walled carbon nanotubes in the single-walled carbon nanotube aqueous solution was $1\times10^{-3}$ wt %.

(4) The microstrips were introduced into a scrapper, and a transparent polymer waterborne polyurethane 9006A slurry was uniformly coated on the surface of the microstrips. After coating, the microstrips were continuously dried and cured in the drying oven at 90° C. for 15 min, and an insulating encapsulation layer was formed after curing. After being wound up, the microstrips were prepared into a semi-finished product of colorful electronic ink microstrips. A concentration of the transparent polymer was 30 wt %, and a thickness of the transparent polymer after curing was 3 μm.

Before encapsulation, the conductive region was cut and disconnected by a low-energy YAG laser with a laser wavelength of 1.06 μm, a spot size of smaller than 0.1 μm, and a scanning speed of 0.1 m/s to 1 m/s to form independent square display pixels. A designed color-rendering fabric or camouflage cloth of any size was woven using the colorful patterned color-changing fabric microstrip semi-finished product and a vertical weaving manner in an order of red, green, and blue. A pixel drive chip was sewn on a back insulating layer. A pin of the pixel drive chip was connected to the conductive yarn connected to an upper electrode on a monochrome color block on a surface of a woven product through sewing to control color and grayscale of a colorful pixel unit. The pixel control circuit was connected to an output port of an image control circuit with the conductive yarn to achieve dynamic display of an image on a textile.

Embodiment 4

The specific preparation process is the same as the specific preparation process of Embodiment 1, and the difference is that in step (3), only a silver nanowire ethanol solution was coated on the surface of the electronic ink cured adhesive layer of the microstrip, the microstrips were dried in the drying oven at 90° C. for 2 min, a flexible transparent conductive layer may be obtained after drying, and a colorful patterned color-changing fabric was further prepared.

Embodiment 5

The specific preparation process is the same as the specific preparation process of Embodiment 1, and the difference is that in step (3), the carbon nanotubes were repeatedly spray-coated, a number of spray-coating was 4 times, and a flexible transparent conductive layer was obtained, and a colorful patterned color-changing fabric was further prepared.

Figure 3:
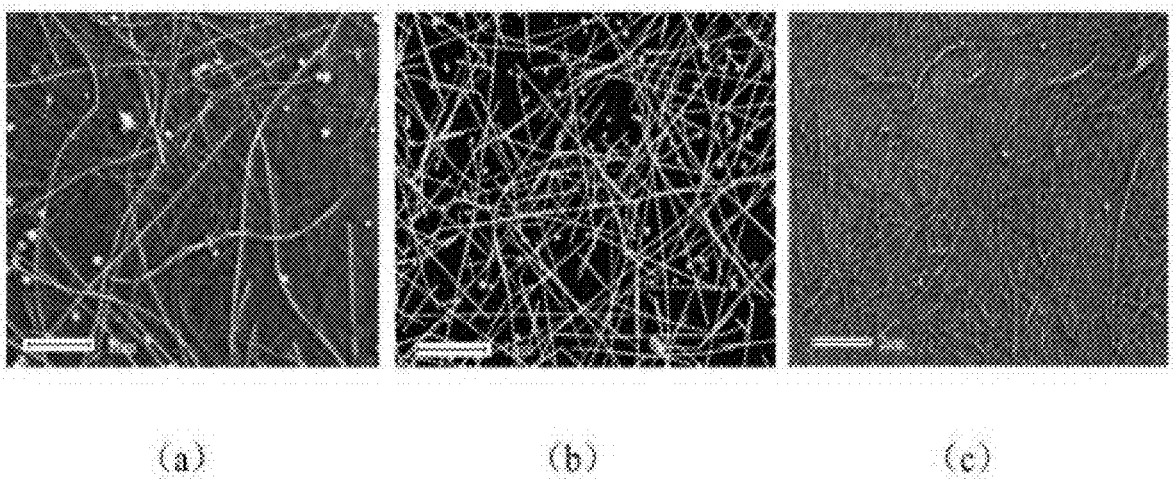
FIG. 3 is scanning electron microscope images of flexible transparent conductive layer of Embodiment 1, Embodiment 4, and Embodiment 5 of the present disclosure.

The flexible transparent conductive layers prepared in Embodiment 1, Embodiment 4, and Embodiment 5 may be subjected to scanning electron microscopy testing. It can be seen from FIG. 3 that (a) is the test result of Embodiment 1, (b) is the test result of Embodiment 4, (c) is the test result of Embodiment 5, only the silver nanowires are coated, silver nanowires may be sparsely distributed on the surface conductive layer, and when an amount of coated carbon nanotubes is relatively small, the carbon nanotubes may fill gaps of the silver nanowire network to form a charge layer; when there is a moderate density (square resistance of ~100Ω) of silver nanowires and carbon nanotubes, a light transmittance of the flexible transparent conductive layer is higher than 90%, and a flipping voltage of the flexible transparent conductive layer is lower than that of Embodiment 4.

The results of capacitance testing of the flexible conductive layers of Embodiment 1, Embodiment 4, and Embodiment 5 are shown in Table 1.

TABLE 1

| | Silver nanowires | Silver nanowires + carbon nanotubes 1 | Silver nanowires + carbon nanotubes 2 | Silver nanowires + carbon nanotubes 3 |
|---|---|---|---|---|
| Opaque Electrodes | 440 | 475 | 1085 | 1391 |
| Transparent Electrodes | 38 | 400 | 968 | 1164 |

Table 1 shows capacitance values (pF) of different flexible conductive layers at a 100 kHz voltage relative to an indium tin oxide (ITO) electrode for measuring an electronic ink layer with the same thickness. Silver nanowires, silver nanowires+carbon nanotubes 1, silver nanowires+carbon nanotubes 2, and silver nanowires+carbon nanotubes 3 are electrodes of Embodiment 4, Embodiment 1, Embodiment 5, and a silver nanowire layer coated with 6 layers of carbon nanotubes, respectively.

Figure 4:
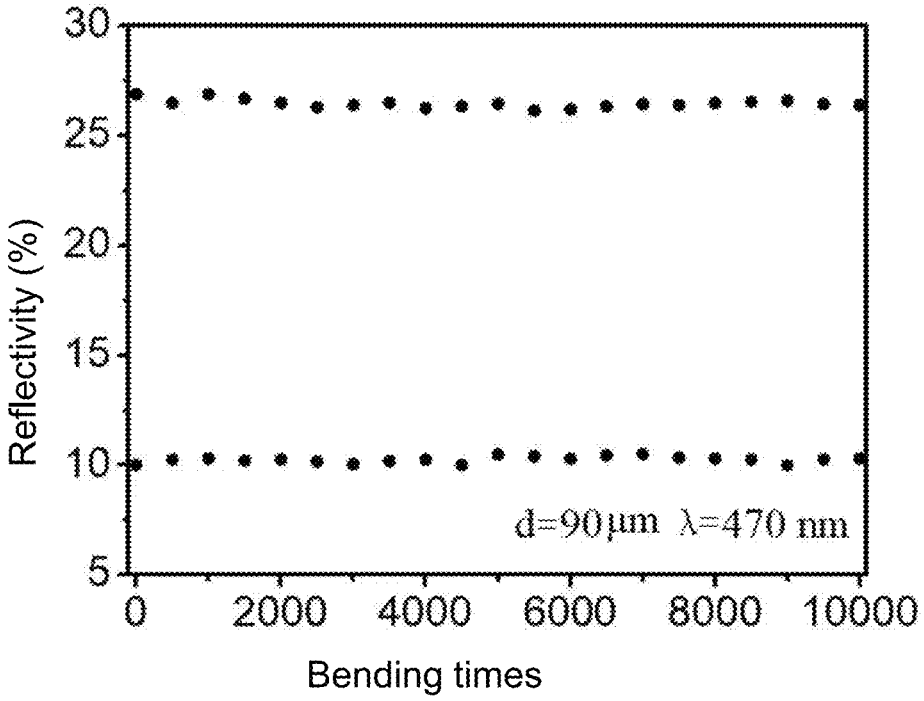
FIG. 4 is a schematic diagram illustrating an exemplary relationship between reflectivity and bending times after the microstrip coated with a flexible transparent conductive layer in Embodiment 1 is flipped.

The stability of the electrode of Embodiment 1 is characterized by measuring the reflectivity after the flip discoloration after repeated bending, and the results show that the carbon nanotubes significantly increase the bending stability. FIG. 4 is a test result of Embodiment 1. When the bending diameter is 6 mm, there is no significant change in the discoloration characteristics of 10,000 bending.

What is claimed is:

1. A method for preparing an electronic-ink-based colorful patterned color-changing fabric, the electronic-ink-based colorful patterned color-changing fabric including a conductive fabric microstrip formed by weaving using conductive yarn and insulating yarn, the conductive yarn forming a conductive region, the insulating yarn forming an insulating region, an electronic ink microencapsule layer being arranged on the conductive region for image display, the electronic ink microencapsule layer including an electronic ink microencapsule slurry and an adhesive, a flexible transparent conductive layer being arranged on the electronic ink microencapsule layer for providing an electrophoretic color rendering voltage, the flexible transparent conductive layer including a single-walled carbon nanotube and a silver nanowire slurry, a transparent polymer layer being arranged on the conductive fabric microstrip for encapsulation, wherein the method comprises:

step 1, weaving the conductive yarn and the insulating yarn into the conductive fabric microstrip using a double-layer warp knitting process, the conductive yarn and the insulating yarn constructing the conductive region and the insulating region, respectively, on the fabric microstrip;

step 2, uniformly coating the electronic ink microencapsule slurry mixed with the adhesive to the conductive region and forming the electronic ink microencapsule layer after curing;

step 3, coating the silver nanowire slurry on a surface of the electronic ink microencapsule layer and drying, coating a single-walled carbon nanotube aqueous solution on the dried surface of the electronic ink microencapsule layer to form the flexible transparent conductive layer after being blow-dried, and sewing the conductive yarn in a direction perpendicular to a length of the conductive fabric microstrip, so that the conductive yarn conduct with the flexible transparent conductive layer and are fixed to the conductive fabric microstrip;

step 4, cutting and disconnecting the conductive region with a low-energy Yttrium Aluminum Garnet (YAG) laser to form independent display pixels;

step 5, uniformly coating a transparent polymer slurry on a surface of the conductive fabric microstrip to form the transparent polymer layer;

step 6, applying a voltage output from a drive circuit to the conductive region and the flexible transparent conductive layer respectively to flip color rendering of a discrete single pixel for by electrophoresis; and step 7, weaving or splicing the conductive fabric microstrip into a dynamic color rendering module with a fixed pixel density or a fixed size, and splicing a plurality of modules together to form a display device expandable to any size; and modulating, by a pixel selection chip, a voltage of the dynamic color rendering module through a gate voltage control drive circuit to display a simulated environment fusion pattern on the dynamic color rendering module.

2. The method for preparing the electronic-ink-based colorful patterned color-changing fabric of claim 1, wherein in the step 2, a volume ratio of the electronic ink microencapsule slurry to the adhesive is (1.5~2.5):1, the adhesive being a waterborne polyurethane, a waterborne polyacrylic acid, or a mixture of the waterborne polyurethane and the waterborne polyacrylic acid, a concentration of the adhesive being 10 wt %~30 wt %, and a concentration of the electronic ink microencapsule slurry being 1.1 $g/cm^3$~1.3 $g/cm^3$.

3. The method for preparing the electronic-ink-based colorful patterned color-changing fabric of claim 2, wherein in the step 3, a concentration of silver nanowires in the silver nanowire slurry is $1\times10^{-2}$ wt %~$1\times10^{-3}$ wt %, and a concentration of single-walled carbon nanotubes in the single-walled carbon nanotube aqueous solution is $1\times10^{-3}$ wt %~$1\times10^{-4}$ wt %.

4. The method for preparing the electronic-ink-based colorful patterned color-changing fabric of claim 2, wherein in the step 5, a transparent polymer in the transparent polymer layer includes the waterborne polyurethane, the waterborne polyacrylic acid, or the mixture of the waterborne polyurethane and the waterborne polyacrylic acid, a concentration of the transparent polymer is 10 wt %~30 wt %, and a thickness of the transparent polymer after curing is 1 μm~3 μm.

5. The method for preparing the electronic-ink-based colorful patterned color-changing fabric of claim 1, wherein the conductive fabric microstrip is a double-layer structure formed by the conductive yarn and the insulating yarn through weaving, bonding, or knitting, the conductive region is located at a central surface of the conductive fabric microstrip, and the insulating region is located at an edge and a bottom of the conductive fabric microstrip.

6. The method for preparing the electronic-ink-based colorful patterned color-changing fabric of claim 5, wherein the conductive yarn includes at least one of silver-plated conductive yarn or conductive nano-material-coated conductive yarn, a yarn size of the at least one of silver-plated conductive yarn or conductive nano-material-coated conductive yarn being smaller than or equal to 100 D, and a monofilament size of the at least one of silver-plated conductive yarn or conductive nano-material-coated conductive yarn being smaller than or equal to 30 D; and the insulating yarn includes at least one of nylon, polyester, or polypropylene, or blended yarn, a yarn size of the at least one of nylon, polyester, or polypropylene, or blended yarn being smaller than or equal to 100 D, and a monofilament size of the at least one of nylon, polyester, or polypropylene, or blended yarn being smaller than or equal to 15 D.

7. The method for preparing the electronic-ink-based colorful patterned color-changing fabric of claim 1, wherein the silver nanowire slurry is an ethanol solution of the silver nanowires or an aqueous solution of the silver nanowires, and the silver nanowires have an average diameter of 15 nm~20 nm and an aspect ratio of 1000~2000.

8. The method for preparing the electronic-ink-based colorful patterned color-changing fabric of claim 1, wherein the electronic ink microencapsule slurry includes electrophoretic particles that achieve two-color interchanging under different voltages or multicolor electrophoretic particles with different electrophoretic mobility, the two-color interchanging includes interchanging of at least one of black and white, blue and white, red and white, or green and white.

9. The method for preparing the electronic-ink-based colorful patterned color-changing fabric of claim 1, wherein the conductive fabric microstrip is further provided with the drive circuit for applying the voltage and the pixel selection chip for controlling the drive circuit to form a pattern on a surface of the color-changing fabric, the pixel selection chip being signally connected to the drive circuit, and a signal output end of the drive circuit being connected to the conductive region and the flexible transparent conductive layer respectively.

* * * * *